US007531466B2

(12) United States Patent
Zhuang et al.

(10) Patent No.: US 7,531,466 B2
(45) Date of Patent: May 12, 2009

(54) METAL ORGANIC DEPOSITION PRECURSOR SOLUTION SYNTHESIS AND TERBIUM-DOPED $SiO_2$ THIN FILM DEPOSITION

(75) Inventors: Wei-Wei Zhuang, Vancouver, WA (US); Yoshi Ono, Camas, WA (US); Tingkai Li, Vancouver, WA (US)

(73) Assignee: Sharp LaborAtories of America, Inc., Camas, WA (US)

( * ) Notice: Subject to any disclaimer, the term of this patent is extended or adjusted under 35 U.S.C. 154(b) by 400 days.

(21) Appl. No.: 11/494,141

(22) Filed: Jul. 26, 2006

(65) Prior Publication Data

US 2008/0026590 A1 Jan. 31, 2008

(51) Int. Cl.
*H01L 21/31* (2006.01)

(52) U.S. Cl. ..... 438/783; 438/787; 257/E21.279

(58) Field of Classification Search ..... 438/783, 438/787, 790; 501/64
See application file for complete search history.

(56) References Cited

U.S. PATENT DOCUMENTS 5,196,383 A * 3/1993 Ito et al. ..... 501/12
2002/0087018 A1* 7/2002 Celinska et al. ..... 556/105
2003/0035642 A1* 2/2003 Bryan ..... 385/129
2003/0227116 A1* 12/2003 Halik et al. ..... 267/202

OTHER PUBLICATIONS

Zhang et al., *Deposition and photolkuminescence of sol-gel derived $TB^{3+}$ : $Zn_2SiO_4$ films on $SiO_2$/Si*; Thin Solid Films 370 pp. 50-53 (2000).
Wang et al.; *Synthesis and Luminescent Properties of Tb-doped $SiO_2$-$B_2O_3$NaF Glass*; Actu Phys.-Chem Sin. vol. 19, pp. 398-402 (2003).
Di et al.; *Temperature dependence of structural and luminescent properties of $Tb^{3+}$ doped $YPO_4$*; Proc. of SPIE vol. 6030 pp. M1-M8 (2006).
Lin et al.; *Characterization and Photoluminescence Properties of Tb-doped $SiO_2$ Nanowires as a Novel Green-Emitting Phosphor; Chem. Mater; Vil 19*, pp. 2585-2588 (2007).

* cited by examiner

*Primary Examiner*—Alexander G Ghyka
*Assistant Examiner*—Reema Patel
(74) *Attorney, Agent, or Firm*—David C. Ripma

(57) ABSTRACT

A method of making a doped silicon oxide thin film using a doped silicon oxide precursor solution includes mixing a silicon source in an organic acid and adding 2-methoxyethyl ether to the silicon source and organic acid to from a preliminary precursor solution. The resultant solution is heated, stirred and filtered. A doping impurity is dissolved in 2-methoxyethanol to from a doped source solution, and the resultant solution mixed with the previously described resultant solution to from a doped silicon oxide precursor solution. A doped silicon oxide thin film if formed on a wafer by spin coating. The thin film and the wafer are baked at progressively increasing temperatures and the thin film and the wafer are annealed.

6 Claims, 1 Drawing Sheet

METAL ORGANIC DEPOSITION PRECURSOR SOLUTION SYNTHESIS AND TERBIUM-DOPED $SIO_2$ THIN FILM DEPOSITION

FIELD OF THE INVENTION

This invention relates to doped silicon oxide spin-coating precursors, and specifically to a terbium-doped silicon oxide thin film precursor.

BACKGROUND OF THE INVENTION

Known precursor solutions for the deposition of terbium based thin films are unstable, and must be used within a very short time after the precursor components are combined. Silicon oxide thin films have broad applications in many semiconductor industry areas. Silicon oxide thin films, with doping elements having specific properties, are of the greatest importance in many new devices. One example is a terbium-doped $SiO_2$ thin film, which exhibits both photoluminescence and electroluminescence, has potential applications in the fabrication of electroluminescent devices.

There are many known techniques in use to fabricate an $SiO_2$ thin film, such as PECVD, thermal oxidation, PVD and spin-coating. Each process produces a $SiO_2$ thin film having different specific properties. For example, thermal oxidation processes produce a $SiO_2$ thin film having extremely high uniformity and reliability, and is often used for fabrication of a gate oxide layer. The spin-coating process lends itself to composition adjustment for deposition of a $SiO_2$ thin film doped with various impurities, such as terbium oxide.

Prior art $SiO_2$ spin-coating precursor synthesis usually incorporate a TEOS ($Si(OCH_2CH_3)_4$) component, which provides a source of silicon. However, TEOS is exceptionally volatile, and a single coating of TEOS-based $SiO_2$ is too thin to be of much use, requiring multiple coating steps to build a usable $SiO_2$ thin film. The incorporation of impurities, such as terbium, into a TEOS-based solution results in precipitate formation, which renders the solution unusable in spin-on applications.

A commercialized $SiO_2$ spin-coating precursor solution, know as SOG (spin on glass) solution, produced by Dow Chemical Company, includes of a family of materials having silicon-oxygen (Si—O—Si) backbone structures. A detailed composition of SOG is not known, as the solution is proprietary to the manufacturer, so it is not known whether the commercialized SOG precursor is suitable for use in the method of the invention described and claimed herein.

SUMMARY OF THE INVENTION

A method of making a doped silicon oxide thin film using a doped silicon oxide precursor solution includes mixing a silicon source in an organic acid; adding 2-methoxyethyl ether to the silicon source and organic acid to from a preliminary precursor solution; heating and stirring the preliminary precursor solution; filtering the preliminary precursor solution; dissolving a doping impurity in 2-methoxyethanol to from a doped source solution; mixing the preliminary precursor solution and the doped source solution to from a doped silicon oxide precursor solution; forming a doped silicon oxide thin film on a wafer by spin coating the doped silicon oxide precursor solution onto the wafer; baking the thin film and the wafer at progressively increasing temperatures; and annealing the thin film and the wafer at least once.

It is an object of the invention to provide a stable doped silicon oxide spin-coating precursor.

It is another object of the invention to provide a stable terbium-doped silicon oxide spin-coating precursor.

This summary and objectives of the invention are provided to enable quick comprehension of the nature of the invention. A more thorough understanding of the invention may be obtained by reference to the following detailed description of the preferred embodiment of the invention in connection with the drawings.

DETAILED DESCRIPTION OF THE PREFERRED EMBODIMENTS

The method of the invention provides a doped precursor solutions for doped $SiO_2$ thin film deposition via a spin-coating process. The solution is stable and the synthesis method is reproducible. By adjusting the silicon concentration, a high quality $SiO_2$ or doped-$SiO_2$ thin film, in a wide range of thickness, from about 10 nm to 500 nm may be fabricated. The newly developed precursor solutions are low in cost, making commercialization more feasible. Doped $SiO_2$ thin films have many applications, one example of which is a Tb-doped $SiO_2$ thin film, which exhibits strong photoluminescence signals, and has application to electroluminescent devices, and is used as an example herein.

The goal of synthesizing a $SiO_2$ spin coating precursor according to the method of the invention is to fabricate a terbium-doped silicon oxide thin film as the active layer in an electroluminescent device. Thus, the synthesis of the $SiO_2$ spin coating precursor is the first step, followed by the incorporation of terbium ions into the solution. As previously noted, $SiO_2$ spin-coating precursors usually incorporate TEOS ($Si(OCH_2CH_3)_4$) as a source of silicon. Because of the high volatility of TEOS, a single coating of $SiO_2$ is too thin to be of much use, thus, multiple coating steps are required to build a usable $SiO_2$ thin film. The incorporation of terbium into a TEOS-based solution results in precipitate formation, which renders the solution unacceptable for spin-on applications. Thus, the $SiO_2$ spin-coating precursor solution used in the method of the invention uses $SiCl_4$ as the silicon source.

Because $SiCl_4$ is highly reactive, large organic molecules may be reacted with $SiCl_4$ to form a high molecular weight species, which has much less volatility than does a TEOS compound. A high molecular weight acid was initially selected to be reacted with $SiCl_4$, however, the resultant solution did not provide a sufficiently high quality $SiO_2$ thin film. Instead of a high molecular weight organic acid, a lower molecular weight ethylene glycol-type organic acid was selected, e.g., diethylene glycol monoethyl ether (DGME). Initially, the molar ratio of $SiCl_4$ to DGME was 1:4, however, that solution had poor wetting properties on both $SiO_2$ and silicon. After reducing the molar ratio to 1:2, a precursor solution which resulted in a high quality $SiO_2$ thin film was synthesized.

Figure 1:
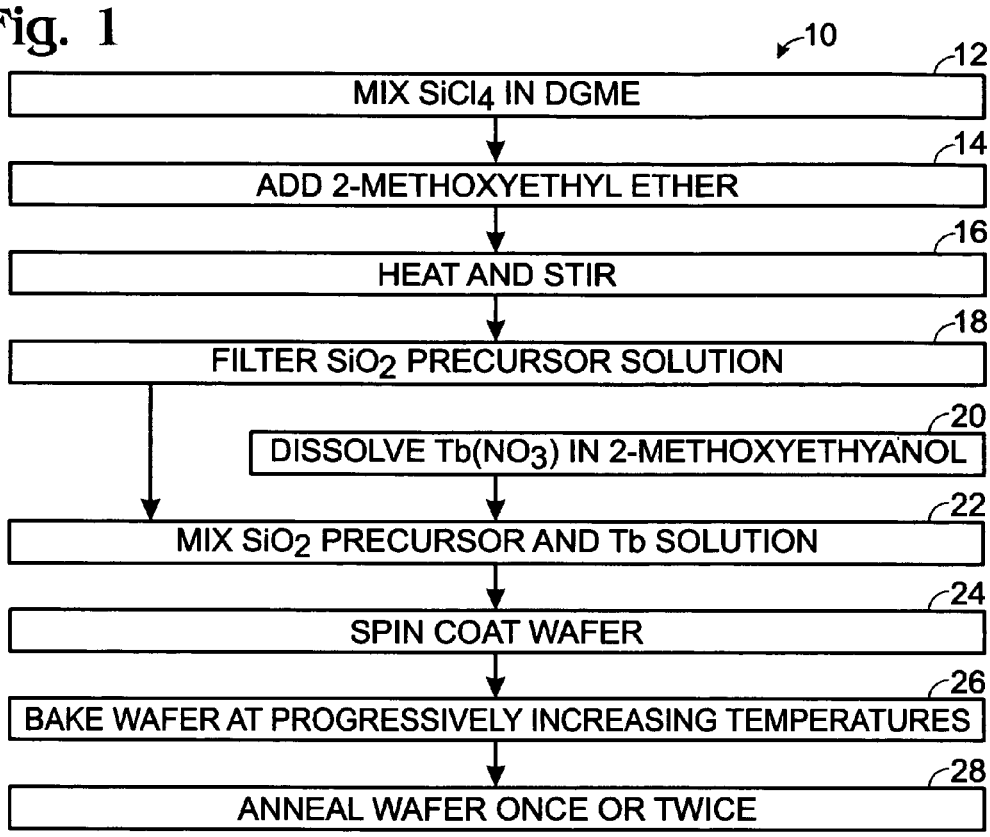
FIG. 1 is a block diagram of the method of the invention.

The method of the invention, shown generally at 10 in FIG. 1, is as follows: to a 500 mL round bottom flask, having 95 mL of DGME therein, 40 mL of $SiCl_4$ is slowly added, step 12. Hydrogen gas is generated during the addition, and carried out via nitrogen gas flow. After the addition of $SiCl_4$, 150 mL of 2-methoxyethyl ether is added, step 14, to from a preliminary precursor solution. The preliminary precursor solution is then heated at 150° C. in an oil bath for 16 hours, with constant stirring, step 16. The solution is filtered through a 0.2 μm filter for purification, step 18.

A doped source solution, containing about 11% terbium, is made by incorporating the impurity into 2-methoxyethanol, which, in the preferred embodiment, includes introducing terbium ions from 12.18 gm of $Tb(NO_3)_3$ into 14 mL of 2-methoxyethanol, step 20, and mixing, step 22, the doped source solution into the preliminary precursor solution, to form a doped-$SiO_2$ spin-coating precursor solution. Any resultant solid precipitate may be dissolved by adding a few drops of water to obtain a clear solution. The concentration of silicon in the doped-$SiO_2$ spin-coating precursor solution may be adjusted by addition of organic solvents. Other doping impurities may be used, e.g., other rare-earth elements.

Figure 2:
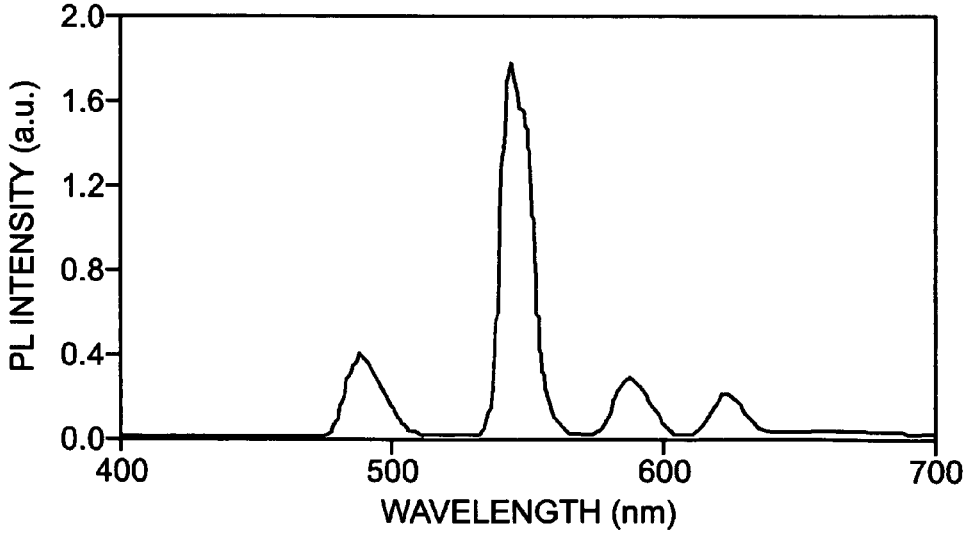
FIG. 2 is a PL spectrum of a terbium-doped $SiO_2$ thin film.

To produce a Tb-doped $SiO_2$ thin film, the doped-$SiO_2$ spin-coating precursor solution is spin-coated on a silicon wafer surface, step 24, and then baked at about 160°, 220° and 300° C. for one minute at each temperature, step 26. Baking may be done in a range of temperatures, e.g., 150° C. to 170° C., 180° C. to 250° C.; and 260° C. to 320° C. The resultant film is further annealed, step 28, at about 700° C. for about 10 minutes in an oxygen atmosphere. To produce a high photoluminescence signal, the film is again annealed, this time at between about 900° to 1100° C. for between about one to forty minutes, an a wet oxygen ambient atmosphere. The typical photoluminescence spectrum for a thin film fabricated according to the method of the invention is depicted in FIG. 2.

Thus, a method of producing a stable, doped $SiO_2$ spin-coating precursor has been disclosed. It will be appreciated that further variations and modifications thereof may be made within the scope of the invention as defined in the appended claims.

We claim:

1. A method of making a doped silicon oxide thin film using a doped silicon oxide precursor solution, comprising:

mixing a silicon source in an organic acid;

adding 2-methoxyethyl ether to the silicon source and organic acid to form a preliminary precursor solution;

heating and stirring the preliminary precursor solution;

filtering the preliminary precursor solution;

dissolving a doping impurity in 2-methoxyethanol to form a doped source solution;

mixing the preliminary precursor solution and the doped source solution to form a doped silicon oxide precursor solution;

forming a doped silicon oxide thin film on a wafer by spin coating the doped silicon oxide precursor solution onto the wafer;

baking the thin film and the wafer at progressively increasing temperatures; and annealing the thin film and the wafer at least once, including a first anneal at a temperature of about 700° C. for about ten minutes in an oxygen atmosphere.

2. The method of claim 1 wherein said annealing includes a second anneal at a temperature of between about 900° C. to 1100° C. for between about one minute to about forty minutes in a wet oxygen ambient atmosphere to produce a thin film for generating a high photoluminescence signal.

3. A method of making a doped silicon oxide thin film using a doped silicon oxide precursor solution, comprising:

mixing a silicon source in an organic acid;

adding 2-methoxyethyl ether to the silicon source and organic acid to form a preliminary precursor solution;

heating and stirring the preliminary precursor solution;

filtering the preliminary precursor solution;

dissolving $Tb(N0_3)_3$ in 2-methoxyethanol to form a Tb-doped source solution;

mixing the preliminary precursor solution and the Tb-doped source solution to form a Tb-doped silicon oxide precursor solution;

forming a Tb-doped silicon oxide thin film on a wafer by spin coating the Tb-doped silicon oxide precursor solution onto the wafer;

baking the thin film and the wafer at progressively increasing temperatures; and annealing the thin film and the wafer at least once, including a first anneal at a temperature of about 700° C. for about ten minutes in an oxygen atmosphere.

4. The method of claim 3 wherein said annealing includes a second anneal at a temperature of between about 900° C. to 1100° C. for between about one minute to about forty minutes in a wet oxygen ambient atmosphere to produce a thin film for generating a high photoluminescence signal.

5. A method of making a doped silicon oxide thin film using a doped silicon oxide precursor solution, comprising:

mixing a $SiCl_4$ in an ethylene glycol-type organic acid;

adding 2-methoxyethyl ether to the $SiCl_4$ in an ethylene glycol-type organic acid to form a preliminary precursor solution;

heating and stirring the preliminary precursor solution;

filtering the preliminary precursor solution;

dissolving $Tb(NO_3)_3$ in 2-methoxyethanol to form a Tb-doped source solution;

mixing the preliminary precursor solution and the Tb-doped source solution to form a Tb-doped silicon oxide precursor solution;

forming a Tb-doped silicon oxide thin film on a wafer by spin coating the Tb-doped silicon oxide precursor solution onto the wafer;

baking the thin film and the wafer at progressively increasing temperatures; and annealing the thin film and the wafer at least once, including a first anneal at a temperature of about 700° C. for about ten minutes in an oxygen atmosphere.

6. The method of claim 5 wherein said annealing includes a second anneal at a temperature of between about 900° C. to 1100° C. for between about one minute to about forty minutes in a wet oxygen ambient atmosphere to produce a thin film for generating a high photoluminescence signal.

* * * * *